United States Patent [19]

Kaminaga et al.

[11] Patent Number: 4,543,756

[45] Date of Patent: Oct. 1, 1985

[54] HEAT-INSULATING FRAME ASSEMBLY FOR USE IN CORNER OF CURTAIN WALL CONSTRUCTION

[75] Inventors: Hiromitsu Kaminaga; Hiroshi Kondo, both of Kurobe, Japan

[73] Assignee: Yoshida Kogyo K. K., Tokyo, Japan

[21] Appl. No.: 601,156

[22] Filed: Apr. 17, 1984

[30] Foreign Application Priority Data

Apr. 21, 1983 [JP] Japan ..... 58-58665[U]

[51] Int. Cl.[4] ..... E04B 2/88

[52] U.S. Cl. ..... 52/284; 52/235; 52/277; 52/403; 49/DIG. 1

[58] Field of Search ..... 52/235, 277, 278, 282, 52/284, 288, 397–400, 402, 403, 730; 49/DIG. 1, DIG. 2; 285/191; 165/53, 56, 57

[56] References Cited

U.S. PATENT DOCUMENTS

| | | | |
|---|---|---|---|
| 3,070,646 | 12/1962 | Lindgren | 52/277 X |
| 3,196,992 | 7/1965 | Owen | 52/282 |
| 4,100,704 | 7/1978 | Oogami | 52/277 X |
| 4,147,001 | 4/1979 | Oliver | 52/284 |
| 4,458,745 | 7/1984 | Gartner | 165/57 |

FOREIGN PATENT DOCUMENTS

| | | | |
|---|---|---|---|
| 2732458 | 1/1978 | Fed. Rep. of Germany | 52/235 |
| 57-35054 | 8/1982 | Japan . | |
| 2102112 | 1/1983 | United Kingdom | 52/235 |
| 2127876 | 4/1984 | United Kingdom | 52/235 |
| 2128221 | 4/1984 | United Kingdom | 52/235 |

*Primary Examiner*—Donald G. Kelly
*Assistant Examiner*—Richard E. Chilcot, Jr.
*Attorney, Agent, or Firm*—Hill, Van Santen, Steadman & Simpson

[57] ABSTRACT

A heat-insulating frame assembly for use at a corner of a curtain wall construction has an inner frame member having a pair of mutually perpendicular outer walls and an outer frame member having a pair of outer walls extending normally to each other and parallel to the outer walls of the inner frame member. The inner and outer frame members are interconnected by screws fastening the outer walls of the inner and outer frame members through heat-insulating spacers.

4 Claims, 5 Drawing Figures

HEAT-INSULATING FRAME ASSEMBLY FOR USE IN CORNER OF CURTAIN WALL CONSTRUCTION

BACKGROUND OF THE INVENTION

1. Field of the Invention:

The present invention relates to a heat-insulating frame assembly such as a vertical frame member for use in a corner of a curtain wall construction.

2. Description of the Prior Art:

Japanese Utility Model Laid-Open Publication No. 57-35054 shows a prior corner vertical frame member of an integral configuration having opposite sides to which panels are fastened. However, the disclosed corner frame member has proven unsatisfactory in that the integral construction is not sufficiently effective to provide a desired thermal insulation between the interior and exterior sides of a building on which the corner frame member is installed.

SUMMARY OF THE INVENTION

According to the present invention, a heat-insulating frame assembly for use at a corner of a curtain wall construction has an inner frame member having a pair of mutually perpendicular outer walls and an outer frame member having a pair of outer walls extending normally to each other and parallel to the outer walls of the inner frame member. The inner and outer frame members are interconnected by holts fastening the outer walls of the inner and outer frame members through heat-insulating spacers.

It is an object of the present invention to provide a heat-insulating frame assembly for curtain wall constructions which has an increased heat-insulating capability between inner and outer frame members.

Another object of the present invention is to provide a heat-insulating frame assembly for curtain wall constructions which allows inner and outer frame members to be easily and accurately positioned and coupled relatively to each other.

Still another object of the present invention is to provide a heat-insulating frame assembly for curtain wall constructions which permits a panel to be attached to only one side thereof securely and stably.

Many other advantages, features and additional objects of the present invention will become manifest to those versed in the art upon making reference to the detailed description and the accompanying sheets of drawings in which a preferred structural embodiment incorporating the principles of the present invention are shown by way of illustrative example.

DETAILED DESCRIPTION

Throughout the specification, the terms "inner", "outer", "inwardly", and "outwardly" are used with reference to the geometric center of a building to which a curtain wall construction is to be attached.

FIGS. 1 through 5 illustrate a heat-insulating frame assembly incorporated in a corner of a curtain wall construction according to an embodiment of the present invention.

Figure 1:
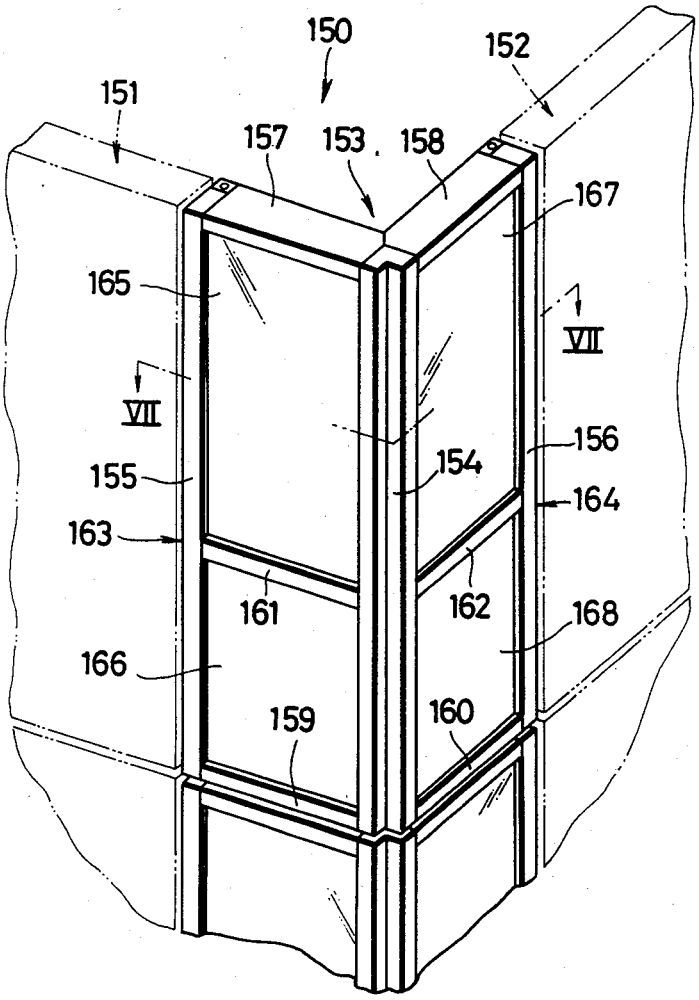
FIG. 1 is a fragmentary perspective view of a corner of a curtain wall construction incorporating therein a heat-insulating frame assembly according to the present invention.

As shown in FIG. 1, a curtain wall construction 150 at a building corner includes a pair of unit curtain walls 151, 152 extending perpendicularly to each other and coupled together by a corner unit 153.

The corner unit 153 is composed of a corner mullion 154 and a pair of vertical frame members 155, 156 which are connected by a pair of upper horizontal frame members 157, 158, a pair of lower horizontal frame members 159, 160 and a pair of transoms 161, 162 located between the upper and lower horizontal frame members 157, 158, 161, 162. The mullion 154, the vertical and horizontal frame members 155, 156, 157, 158, 159, 160, and the transoms 161, 162 jointly provide a pair of lateral frames 163, 164 which retain a pair of upper double-glazed panels 165, 167 and a pair of lower heat-insulating panel and glass assemblies 166, 168.

Figure 2:
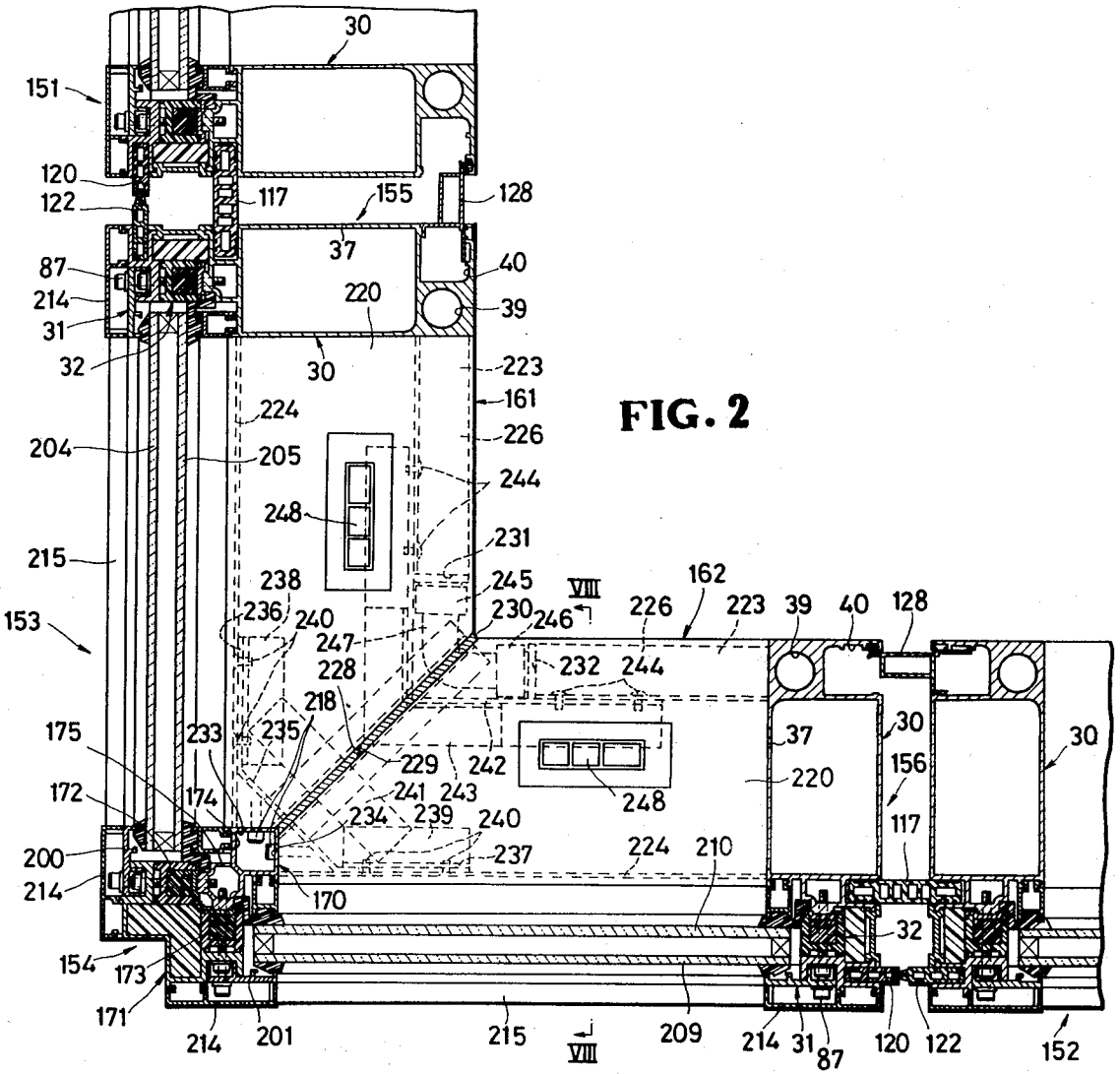
FIG. 2 is a cross-sectional view taken along line VII—VII of FIG. 1.
Figure 4:
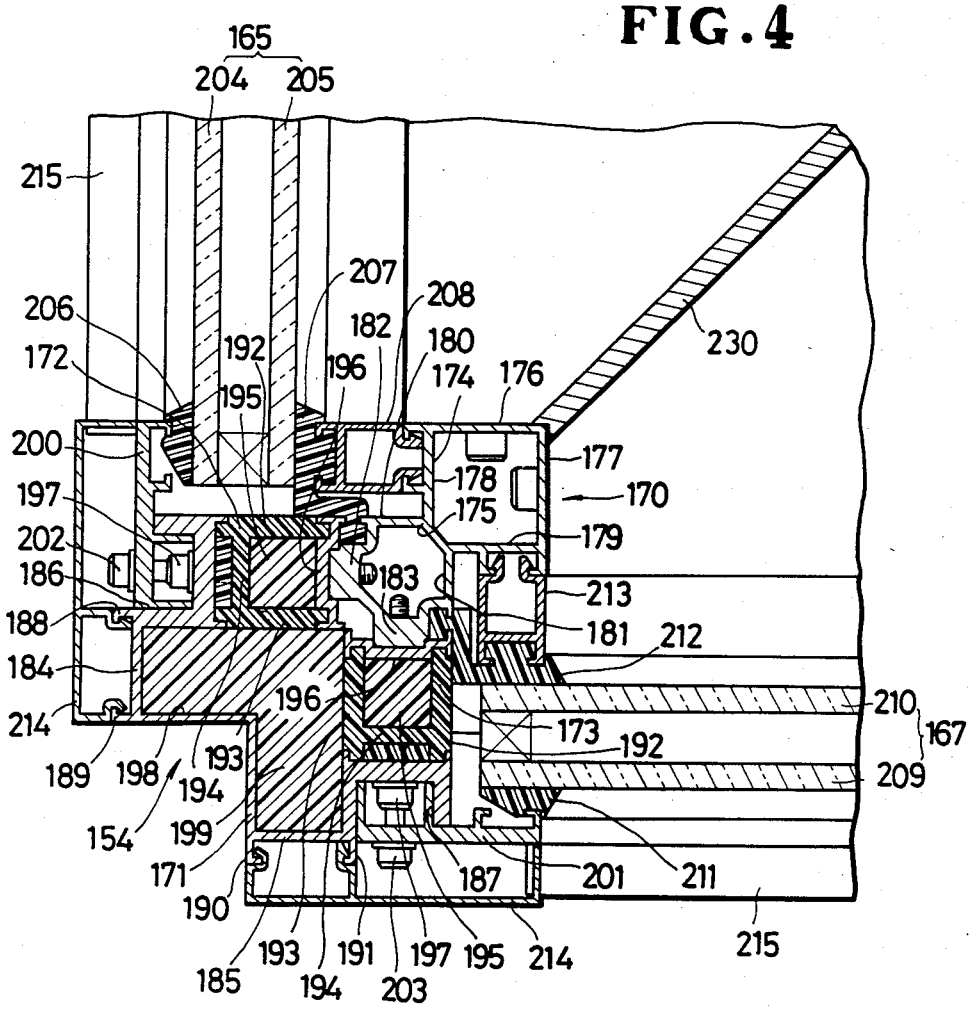
FIG. 4 is an enlarged horizontal cross-sectional view of the heat-insulating frame assembly at the corner of the curtain wall construction shown in FIG. 1.

As illustrated in FIGS. 2 and 4, the corner mullion 154 comprises an inner member 170, an outer member 171, and a pair of spacers 172, 173 by which the inner and outer members 170, 171 are interconnected. The inner member 170 is composed of an inner hollow frame 174 and an outer hollow frame 175. The inner hollow frame 174 has a substantially square cross section including a pair of perpendicular inner side walls 176, 177 and a pair of perpendicular outer side walls 178, 179. Likewise, the outer hollow frame 175 has a substantially square cross section including a pair of perpendicular inner side walls 180, 181 and a pair of perpendicular outer side walls 182, 183. The inner member 170 is symmetrical in shape with respect to a diametrical direction along which the frames 163, 164 are coupled to each other.

The outer member 171 is of a right-angled configuration having a pair of lateral outer walls 184, 185 extending normally to each other and parallel to the outer side walls 182, 183, and including a pair of outwardly opening recesses 186, 187, respectively. The outer wall 184 has a pair of outwardly projecting hooks 188, 189, and the outer wall 185 has a pair of outwardly projecting hooks 190, 191. The outer member 171 is also symmetrical in shape with respect to the diametrical direction along which the frames 163, 164 are coupled to each other.

Each of the spacers 172, 173 is substantially channel-shaped and has a pair of spaced side walls 192, 193 interconnected by a connecting wall 194, the spacers 172, 173 being made of a heat-insulating material such as synthetic resin, hard rubber, for example. Each spacer 172, 173 accommodates therein a heat-insulating block 195. The spacers 172, 173 are disposed between the outer walls 182, 183 of the inner member 170 and the outer walls 184, 185 of the outer member 171, with attachments 196 interposed between the spacers 172, 173 and the outer walls 182, 183 of the inner member 170. The spacers 172, 173 and the attachments 196 are fastened by screws 197 to the outer walls 182, 183 of the inner member 170. The outer member 171 has an L-shaped hollow space 198 which opens toward the inner member 170 and accommodates therein a heat-insulating block 199 of a foamed plastic material. The spacers 172, 173 and the attachments 196 are securely fastened to the inner member 170 by tightening the screws 197.

A pair of battens 200, 201 are fitted respectively in the recesses 186, 187 in the outer member 171 and are fastened by screws 202, 203, respectively to the outer member 171. The double-glazed panel 165 is composed of a pair of glass panes 204, 205 having edges supported by a pair of gaskets 206, 207 between the batten 200 and a batten 208 attached to the inner member 170. Similarly, the double-glazed panel 167 is composed of a pair of glass panes 209, 210 having edges supported by a pair of gaskets 211, 212 between the batten 201 and a batten 213 attached to the inner member 170.

The outer walls 184, 185 of the outer member 171 and the battens 200, 201 are covered by a pair of vertical covers 214, 214 engaging the hooks 188, 189, 190, 191.

As shown in FIG. 2, each of the vertical frame members 155, 156 comprises an inner member 30, an outer member 31 which are interconnected by a screw 87, with a spacer 32 sandwiched between the inner and outer members 30, 31. The inner member 30 includes an inner wall, an outer wall, and a pair of side walls which are integrally joined to define a hollow section 37 as an air passage. The inner wall has a hole 39 of a circular cross section for passage of a heat-transporting medium and a recess 40. The outer wall has a laterally opening vertical recess. An inner gasket band 117 is mounted between the inner member 30 of a respective one of the vertical frame members 155, 156 and the corresponding inner member 30 of a respective one of the adjacent curtain wall units 151, 152. A female outer gasket band 120 has an edge portion fitted in a laterally opening vertical recess in the outer member 31 of a respective one of the vertical frame members, and a male outer gasket band 122 has an edge portion fitted in a laterally opening vertical recess in the corresponding outer member 31 of a respective one of the adjacent curtain wall units 151, 152. The female and male outer gasket bands 120, 122 have interfitting edges, respectively, which are complementary to each other. Designated at 128 are a sealing member.

Figure 3:
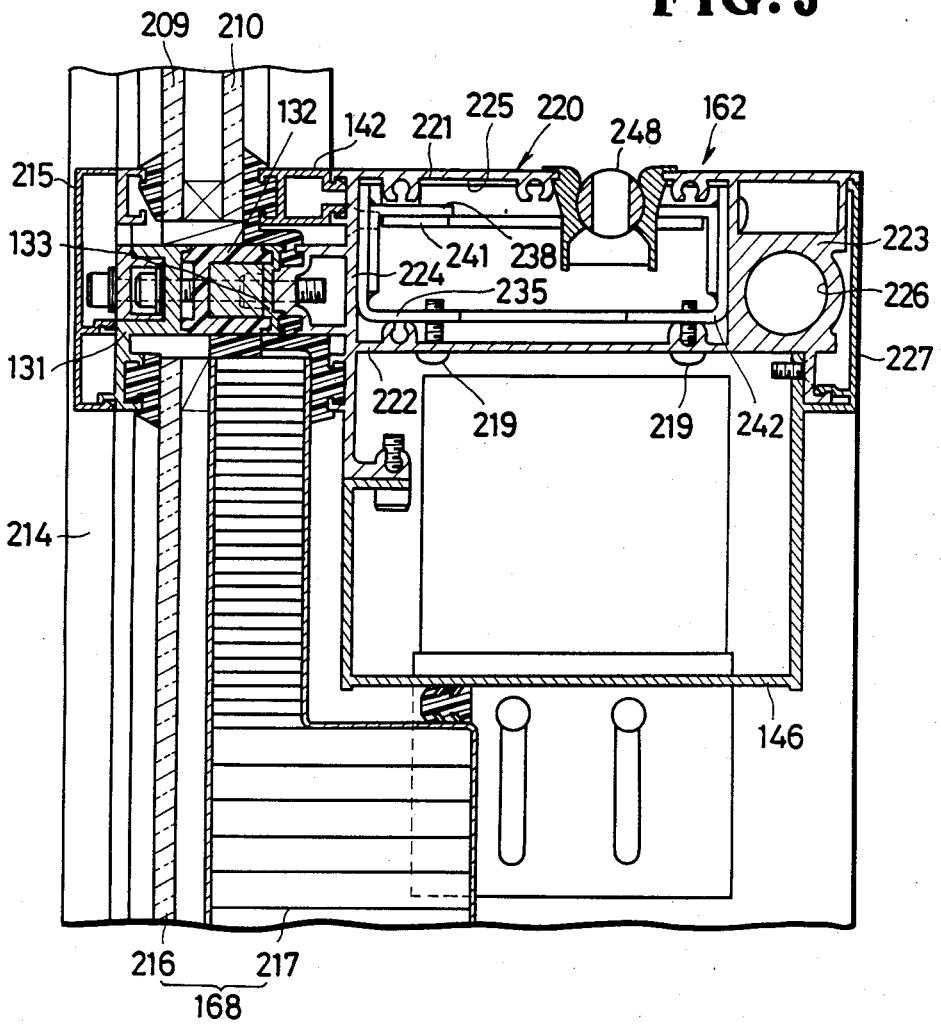
FIG. 3 is a cross-sectional view taken along line VIII—VIII of FIG. 2.

As shown in FIG. 3, the heat-insulating panel and glass assembly 167 is composed of a pane of glass 216 and a heat-insulating panel 217 located inwardly of the glass pane 216. Each of the transoms (only transom 162 is shown in FIG. 3) comprises a transom body 220 composed of an upper wall 221, a lower wall 222, an inner wall 223, and an outer wall 224 which are integral with each other and jointly define a hollow space 225 therein. The inner wall 223 has a hole 226 of a circular cross section for passage of a heat-transporting medium. The inner wall 223 is covered with an inner cover 227. To the outer wall 224 of the transom 162, there are attached an outer member 131, a spacer 132, an attachment 133, a batten 142, with the outer member 131 being covered with a horizontal cover 215.

Figure 5:
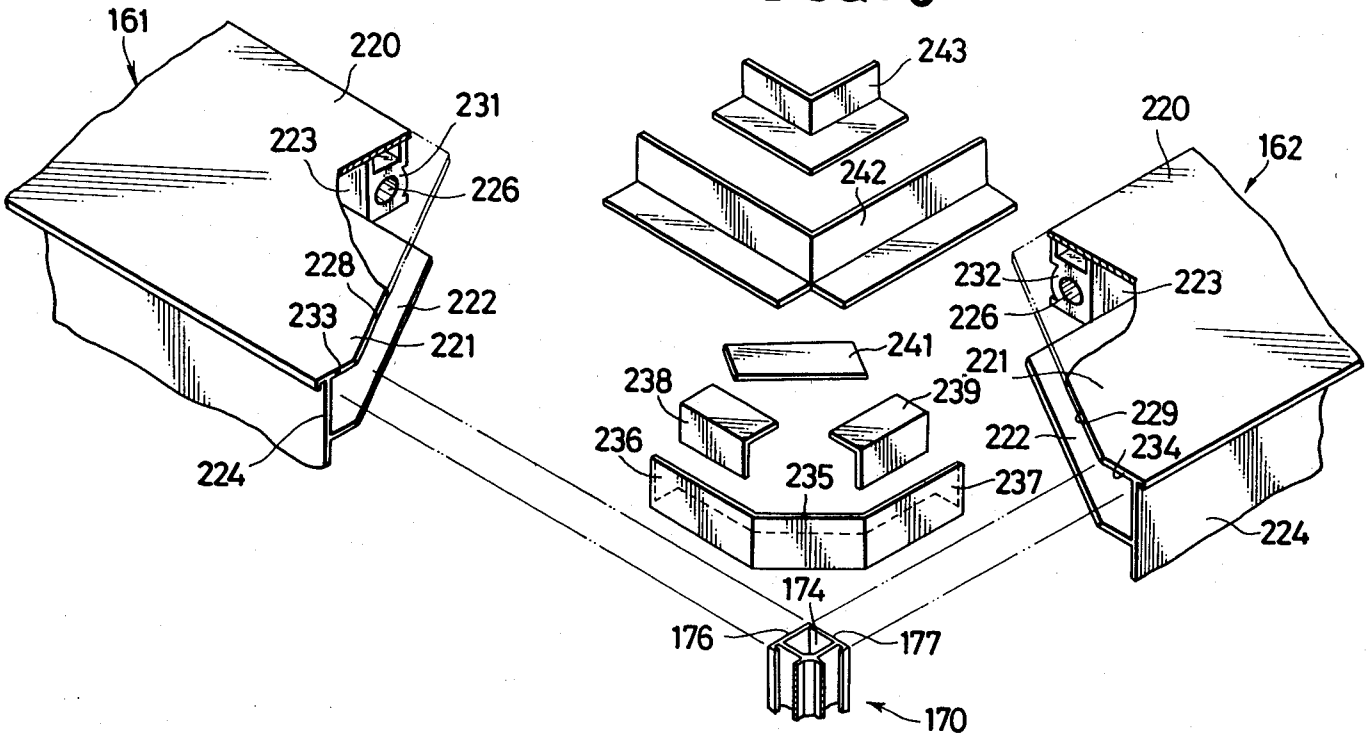
FIG. 5 is an exploded perspective view of an assembly interconnecting adjacent transoms in the corner curtain wall construction illustrated in FIG. 2.

As shown in FIGS. 2 and 5, the transom bodies 220, 220 of the transoms 161, 162 have mitered edges 228, 229, respectively, inclined at an angle of 45 degrees with respect to the longitudinal axes of the transoms 161, 162. The transom bodies 220, 220 are joined at the mitered edges 228, 229 with a caulking material 230 interposed therebetween. The inner walls 223, 223 have edges 231, 232, respectively, lying perpendicularly to each other. The transom bodies 220, 220 also have a pair of mutually perpendicular edges 233, 234 contiguous to the mitered edges 228, 229, respectively, and located outwardly thereof.

The transom bodies 220, 220 are assembled together as follows:

The edges 233, 234 are held respectively against the inner walls 176, 177 of the corner mullion 170, and fastened thereto by screws 218 (FIG. 2). The mitered edges 228, 229 are disposed in confronting relation to each other with the caulking material 230 filled therebetween. A substantially L-shaped outer connector 235 has a pair of arms 236, 237 to which L-shaped inner brackets 238, 239 are attached, respectively. The inner brackets 238, 239 and the arms 236, 237 are secured by screws 240 to the outer walls 224 of the transom bodies 220. A connector 241 is connected to and extends between the brackets 238, 239. An L-shaped inner connector 242 is fixd by a number of screws 244 to outer surfaces of the inner walls 223, 223 of the transom bodies 220, 220. An L-shaped connector 243 is secured to the L-shaped inner connector 242. The L-shaped inner and outer connectors 242, 235 are fastened by screws 219 (FIG. 3) to upper surfaces of the lower wall 222 of the transom bodies 220, 220.

The edges 232, 232 of the inner walls 223, 223 of the transom bodies 220, 220 are coupled by a flexible L-shaped elbow 247 having opposite ends 245, 246 communicating with the holes 226, 226 in the inner walls 223, 223.

The upper wall 221 of the transom bodies 220, 220 support adjustable air ports 248 for allowing air to flow therethrough into and out of the hollow spaces 225 in the transom bodies 220, 220.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A heat-insulating frame assembly comprising:

(a) a first frame member including a pair of first and second walls extending substantially perpendicularly to each other;

(b) a second frame member having a pair of third and fourth walls extending substantially parallel to said first and second walls, respectively;

(c) a pair of first and second spacers of a heat-insulating material disposed between said first and third walls and between said second and fourth walls, respectively;

(d) a pair of first and second screws interconnecting said first and third walls and said second and fourth walls, respectively, through said first and second spacers, respectively; and (e) a block of a heat-insulating material disposed between said first and second frame members.

2. A heat-insulating frame assembly according to claim 1, including a pair of first and second attachments disposed respectively between said first wall and said first spacer and between said second wall and said second spacer.

3. A heat-insulating frame assembly according to claim 1, said second frame member having a substantially L-shaped hollow space opening toward said first frame member, said block being disposed in said hollow space.

4. A heat-insulating frame assembly according to claim 1, each of said first and second spacers comprising a pair of spaced side walls and a connecting wall interconnecting said side walls, including a block of a heat-insulating material disposed between said spaced side walls.

* * * * *